US008506306B2

(12) United States Patent
Liu et al.

(10) Patent No.: US 8,506,306 B2
(45) Date of Patent: Aug. 13, 2013

(54) BOARD MOUNTABLE CONNECTOR

(75) Inventors: Ying-Chih Liu, Hsinchu (TW); Chiung-Wen Hsin, Hsinchu (TW); Yi-Chin Huang, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 243 days.

(21) Appl. No.: 13/043,432

(22) Filed: Mar. 8, 2011

(65) Prior Publication Data

US 2012/0083138 A1 Apr. 5, 2012

(30) Foreign Application Priority Data

Sep. 30, 2010 (TW) ..... 99133223 A

(51) Int. Cl.
*H01R 12/00* (2006.01)

(52) U.S. Cl.
USPC ..... 439/63

(58) Field of Classification Search
USPC ..... 439/63, 581
See application file for complete search history.

(56) References Cited

U.S. PATENT DOCUMENTS

| | | | | |
|---|---|---|---|---|
| 3,514,737 | A * | 5/1970 | Renshaw, Jr. | 439/63 |
| 3,980,382 | A * | 9/1976 | Reeder | 439/581 |
| 4,037,898 | A * | 7/1977 | Guyette | 439/82 |
| 4,605,269 | A * | 8/1986 | Cohen et al. | 439/63 |
| 4,979,903 | A * | 12/1990 | Gosselin | 439/78 |
| 5,559,676 | A * | 9/1996 | Gessaman | 361/752 |
| 5,807,121 | A * | 9/1998 | Fulop et al. | 439/82 |
| 5,897,384 | A * | 4/1999 | Hosler, Sr. | 439/63 |
| 6,106,304 | A * | 8/2000 | Huang | 439/63 |
| 6,109,966 | A * | 8/2000 | Chiou | 439/607.03 |
| 6,140,977 | A * | 10/2000 | Morales et al. | 343/906 |
| 6,199,429 | B1 * | 3/2001 | Hirosawa | 73/504.15 |
| 6,254,399 | B1 * | 7/2001 | Huang | 439/63 |
| 6,780,054 | B2 * | 8/2004 | Yip et al. | 439/607.27 |
| 7,690,922 | B2 * | 4/2010 | Huang | 439/63 |
| 7,713,067 | B1 * | 5/2010 | Behrent | 439/63 |
| 8,035,466 | B2 * | 10/2011 | Payne | 333/260 |
| 2007/0149027 | A1 * | 6/2007 | Chen et al. | 439/345 |

FOREIGN PATENT DOCUMENTS

| | | |
|---|---|---|
| TW | M291129 | 5/2006 |
| TW | 200723587 A | 6/2007 |
| TW | M329916 | 4/2008 |

* cited by examiner

*Primary Examiner* — Neil Abrams

(57) ABSTRACT

An electronic device is provided. The electronic device includes a substrate and a joint. The substrate includes a first surface and a second surface, wherein a substrate signal contact, two ground contacts and two positioning openings are formed on the substrate, and the positioning openings are respectively formed on the ground contact and pass through the substrate. The joint includes a connection port, a joint signal contact and two ground structure, wherein the connection port is electrically connected to the joint signal contact, the joint signal contact is connected to the substrate signal contact, and the joint signal contact is located between the two ground structures, and the ground structures are respectively inserted into the positioning openings to be electrically connected to the ground contacts.

10 Claims, 5 Drawing Sheets

BOARD MOUNTABLE CONNECTOR

CROSS REFERENCE TO RELATED APPLICATIONS

This Application claims priority of Taiwan Patent Application No. 099133223, filed on Sep. 30, 2010, the entirety of which is incorporated by reference herein.

BACKGROUND OF THE INVENTION

1. Field of the Invention

The present invention relates to an electronic device, and in particular relates to an electronic device with an RF connector.

2. Description of the Related Art

Conventionally, two ways are utilized to fix an RF (radio frequency) connector to a print circuit board (PCB). One is an edge mount type way, and the other one is a right angle type way. In the edge mount type way, wave soldering is utilized to weld the RF connector on opposite surfaces of the print circuit board, thus, welding reliability is decreased. In the right angle type way, the RF connector is welded onto a single surface of the print circuit board, and welding reliability thereof is improved. However, RF signal has longer transmission path, thus, the transmission path has a 90 degree corner. causing poor signal performance in high frequency bands.

BRIEF SUMMARY OF THE INVENTION

An electronic device is provided. The electronic device includes a substrate and a joint. The substrate includes a first surface and a second surface, wherein a substrate signal contact, two ground contacts and two positioning openings are formed on the substrate, and the positioning openings are respectively formed on the ground contact and pass through the substrate. The joint includes a connection port, a joint signal contact and two ground structure, wherein the connection port is electrically connected to the joint signal contact, the joint signal contact is connected to the substrate signal contact, and the joint signal contact is located between the two ground structures, and the ground structures are respectively inserted into the positioning openings to be electrically connected to the ground contacts.

In the embodiment of the invention, the L shaped ground structure is utilized for single surface welding (the joint is welded onto only a single surface of the substrate), such that the welding process is easier, and reliability thereof is improved. Additionally, the joint signal contact (signal line) is not bent, and therefore the electronic device (RF device) still has great signal performance in high frequency bands. As well, the ground structures and the positioning structures respectively abut the first surface and the second surface of the substrate to resist the torque applied to the joint, and to prevent the welding material from breaking.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
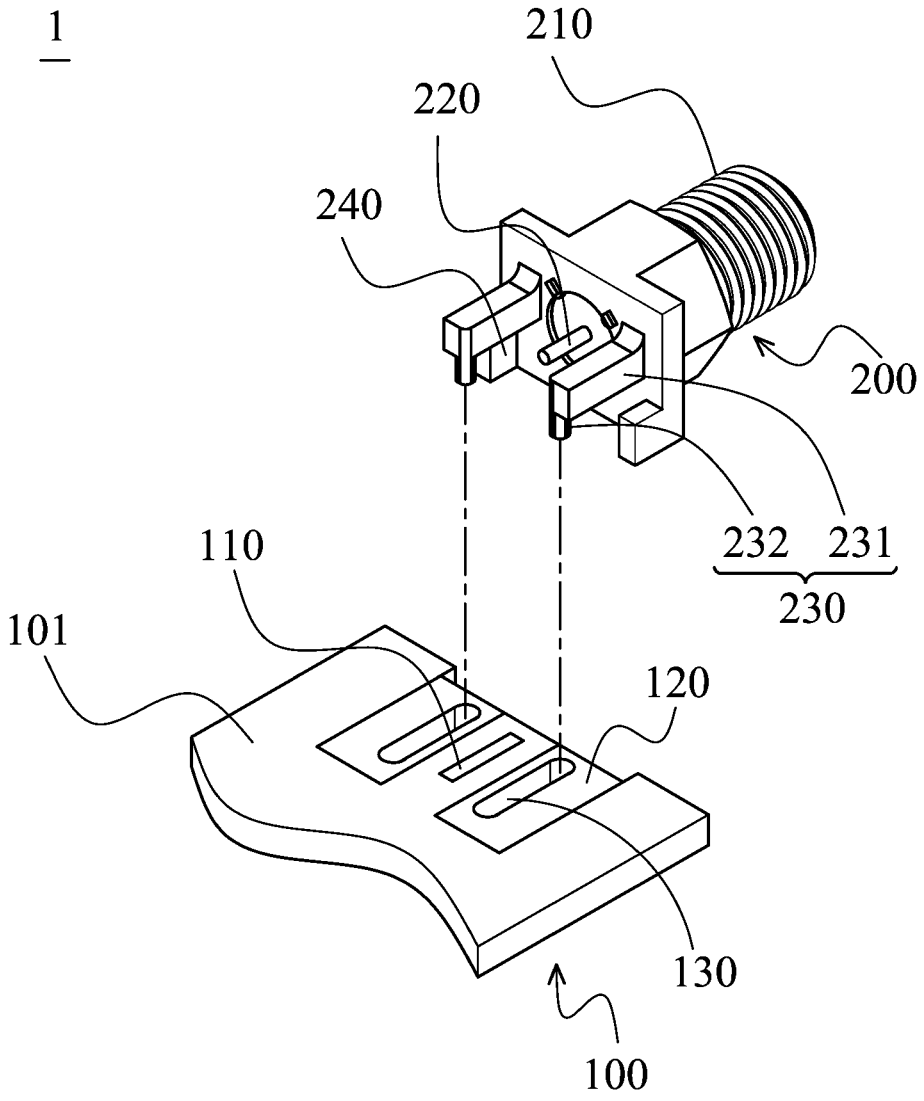
FIG. 1 is an exploded view of an electronic device (RF device) of an embodiment of the invention.
Figure 2A:
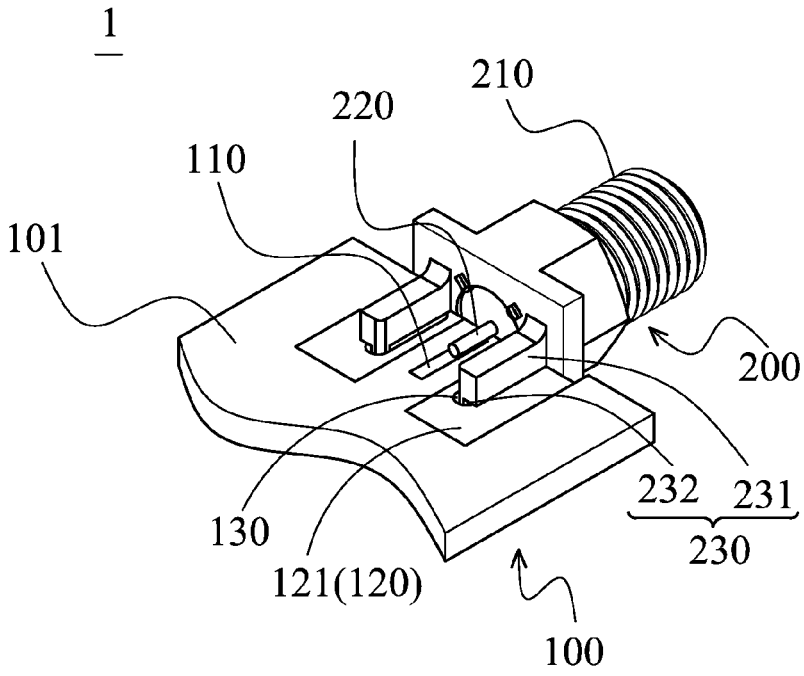
FIG. 2A is an assembly view of the electronic device (RF device) of the embodiment of the invention.

FIG. 1 is an exploded view of an electronic device (RF device) 1 of an embodiment of the invention. The electronic device 1 comprises a substrate 100 and a joint 200. The substrate 100 comprises a first surface 101 and a second surface 102, wherein a substrate signal contact 110, two ground contacts 120 and two positioning openings 130 are formed on the substrate 100. The positioning openings 130 are respectively formed on the ground contacts 120, and pass through the substrate 100. The positioning openings 130 are longitudinal slots, and are parallel to each other. The joint 200 comprises a connection port 210, a joint signal contact 220 and two ground structures 230. The ground structures 230 are parallel to each other. The connection port 210 is electrically connected to the joint signal contact 220, and the joint signal contact 220 is connected to the substrate signal contact 110. FIG. 2A is an assembly view of the electronic device (RF device) 1 of the embodiment of the invention. As shown in FIGS. 1 and 2A, when the electronic device 1 is assembled, the ground structures 230 are inserted into the positioning openings 130 to be electrically connected to the ground contacts 120.

With reference to FIG. 1, the joint signal contact 220 is located between the two ground structures 230. Each ground structure 230 is L shaped, and comprises an extending portion 231 and a positioning portion 232. The positioning portion 232 is connected and perpendicular to the extending portion 231. With reference to FIG. 2A, the extending portion 231 abuts the substrate 100, and the positioning portion 232 is inserted into the positioning opening 130. The extending portions 231 extend in a first direction, and the positioning openings 130 also extend in the first direction.

Figure 2B:
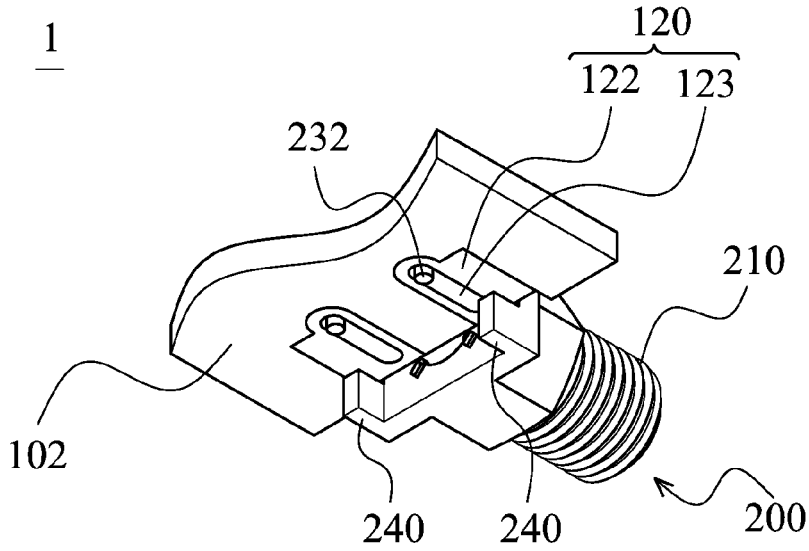
FIG. 2B is an assembly view of the electronic device (RF device) of another visual angle.

FIG. 2B is an assembly view of the electronic device (RF device) 1 of another visual angle. With reference to FIGS. 2A and 2B, each ground contact 120 comprises a first ground portion 121, a second ground portion 122 and a ground conductive portion 123, and the first ground portion 121 is formed on the first surface 101, and the second ground portion 122 is formed on the second surface 102, the ground conductive portion 123 extends along an inner wall of the positioning opening 130 to contact the first ground portion 121 to the second ground portion 122. When the electronic device 1 is assembled, the extending portion 231 abuts the first ground portion 121.

With reference to FIGS. 1 and 2B, the joint 200 further comprises two positioning structures 240, and the positioning structures 240 abut the second surface 102 when the electronic device 1 is assembled.

Figure 3A:
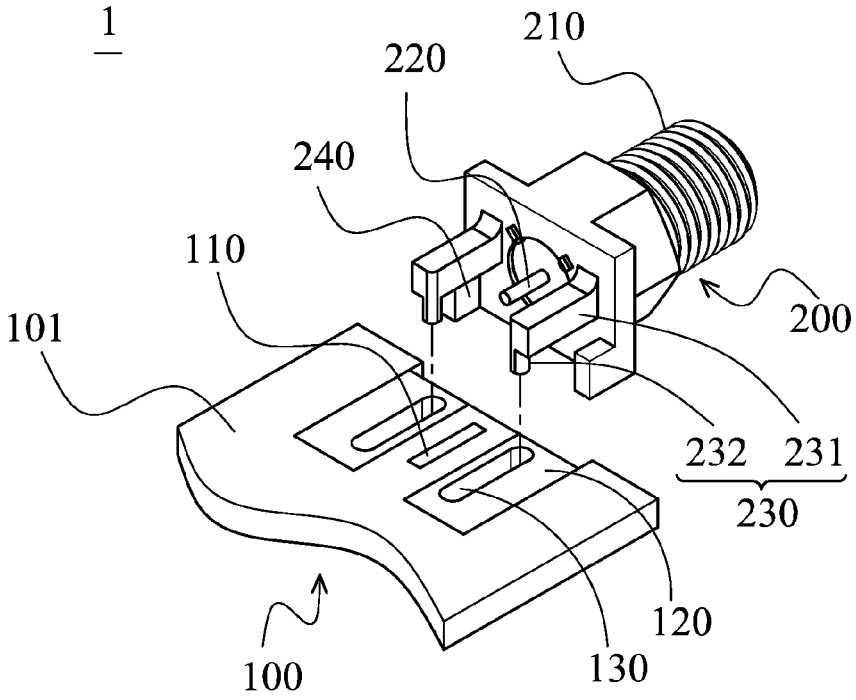
FIGS. 3A, 3B and 3C show assembly process of the electronic device of the invention.
Figure 3B:
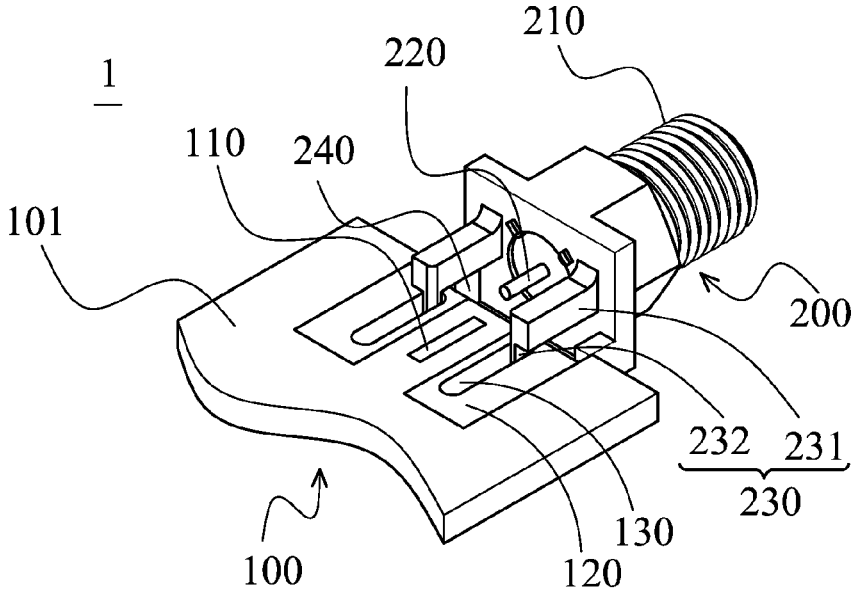
Figure 3C:
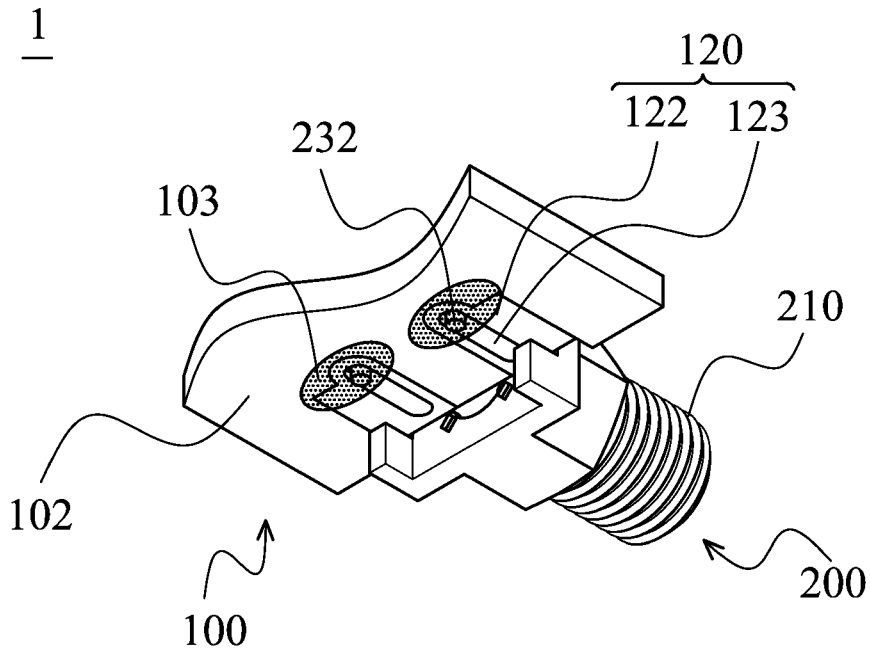

FIGS. 3A, 3B and 3C show the assembly process of the electronic device 1 of the invention. First, as shown in FIG. 3A, the positioning portions 232 are inserted into the positioning openings 130. Next, as shown in FIG. 3B, the joint 200 is pushed to abut an edge of the substrate 100. Finally, as shown in FIG. 3C, welding material 103 is applied to weld the positioning portions 232 to the second ground portions 122 to fix the joint 200.

In the embodiment of the invention, the L shaped ground structure is utilized for single surface welding (the joint 200 is welded onto only a single surface of the substrate 100), such that the welding process is easier, and reliability thereof is improved. Additionally, the joint signal contact (signal line) is not bent, and therefore the electronic device (RF device) still has great signal performance in high frequency bands. As well, the ground structures and the positioning structures respectively abut the first surface and the second surface of the substrate to resist the torque applied to the joint, and to prevent the welding material from breaking.

Figure 4:
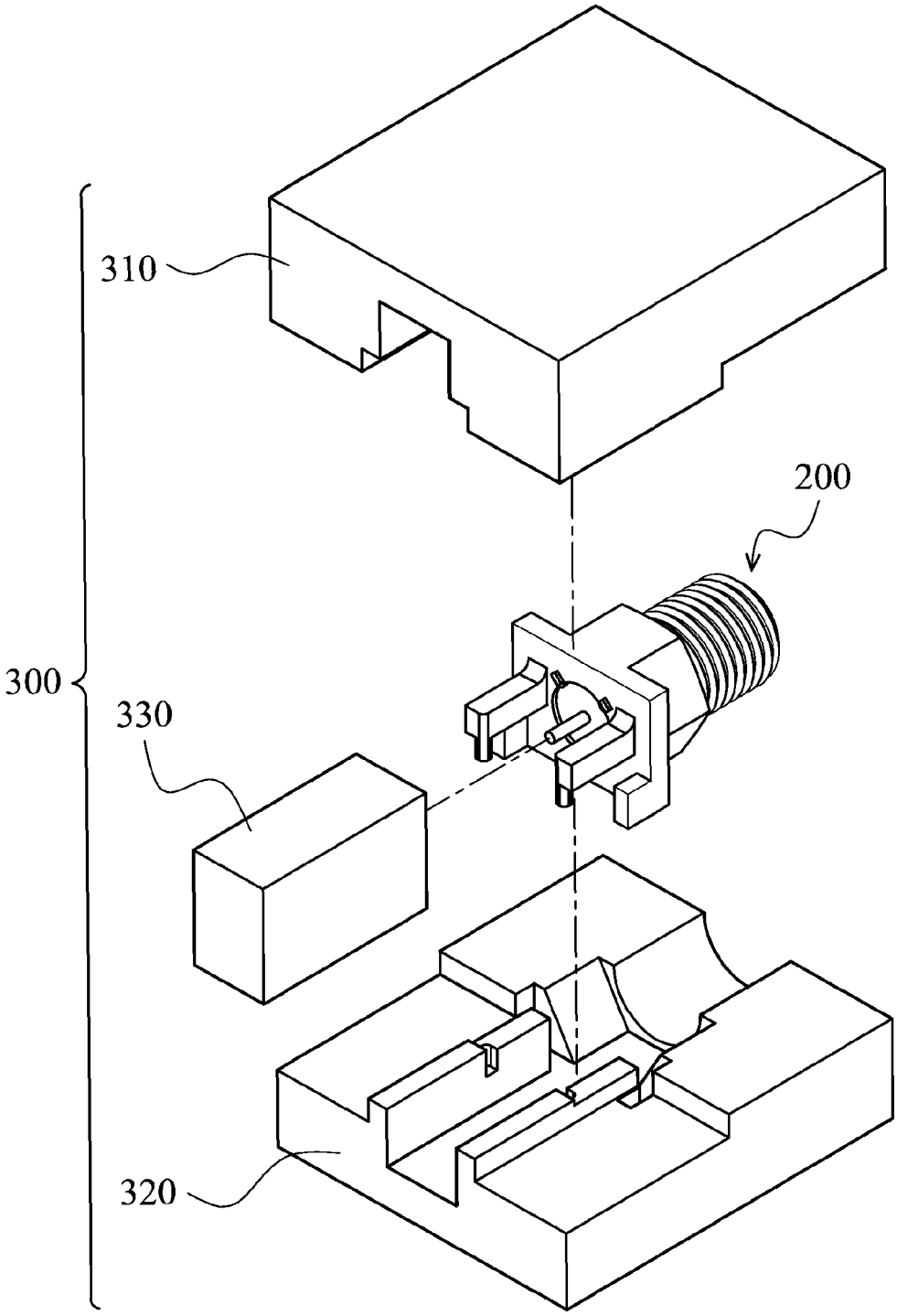
FIG. 4 shows a mold for forming the joint of the embodiment of the invention.

FIG. 4 shows a mold 300 for forming the joint 200, which comprises a mold cavity 310, a mold core 320 and a mold slide 330. The joint 200 of the embodiment of the invention has simpler structure, such that molding cost is thus decreased, and no extra process are required after molding the joint.

In the embodiment of the invention, the number of the ground structures is two, and the number of the positioning structures is two. However, the invention is not limited thereto. In the embodiment of the invention, the number of the ground structures, and the ground contacts, the positioning openings and the positioning structures can be modified.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a substrate, comprising a first surface and a second surface, wherein a substrate signal contact, a ground contact and a positioning opening are formed on the substrate, and the positioning opening is formed on the ground contact and passes through the substrate; and a joint, comprising a connection port, a joint signal contact and a ground structure, wherein the connection port is electrically connected to the joint signal contact, the joint signal contact is connected to the substrate signal contact, and the ground structure is inserted into the positioning opening to be electrically connected to the ground contact, wherein the ground structure comprises an extending portion and a positioning portion, the positioning portion is connected to the extending portion, the extending portion abuts the substrate, and the positioning portion is inserted into the positioning opening, wherein the ground contact comprises a first ground portion, a second ground portion and a ground conductive portion, the first ground portion is formed on the first surface, the second ground portion is formed on the second surface, and the ground conductive portion extends along an inner wall of the positioning opening to contact the first ground portion to the second ground portion, and the extending portion abuts the first ground portion, wherein the joint further comprises a positioning structure, and the positioning structure abuts the second ground portion.

2. The electronic device as claimed in claim 1, wherein the ground structure is L shaped, and the positioning portion is perpendicular to the extending portion.

3. The electronic device as claimed in claim 1, wherein the positioning portion is welded to the second ground portion to fix the joint.

4. The electronic device as claimed in claim 1, wherein the positioning opening is a longitudinal slot.

5. The electronic device as claimed in claim 4, wherein the extending portion extends in a first direction, and the positioning opening extends in the first direction.

6. The electronic device as claimed in claim 1, wherein the ground structure abuts the first surface, and is welded to the second surface.

7. An electronic device, comprising:

a substrate, comprising a first surface and a second surface, wherein a substrate signal contact, two ground contacts and two positioning openings are formed on the substrate, and the positioning openings are respectively formed on the ground contact and pass through the substrate; and a joint, comprising a connection port, a joint signal contact and two ground structure, wherein the connection port is electrically connected to the joint signal contact, the joint signal contact is connected to the substrate signal contact, the joint signal contact is located between the two ground structures, and the ground structures are respectively inserted into the positioning openings to be electrically connected to the ground contacts, wherein the ground structures are parallel to each other, each ground structure comprises an extending portion and a positioning portion, the positioning portion is connected to the extending portion, the extending portion abuts the substrate, and the positioning portion is inserted into the positioning opening, wherein each of the ground contact comprises a first ground portion, a second ground portion and a ground conductive portion, the first ground portion is formed on the first surface, the second ground portion is formed on the second surface, and the ground conductive portion extends along an inner wall of the corresponding positioning opening to contact the first ground portion to the second ground portion, and the extending portion abuts the first ground portion, wherein the joint further comprises two positioning structures, and the positioning structures respectively abut the second ground portions.

8. The electronic device as claimed in claim 7, wherein the positioning openings are longitudinal slots, and the positioning openings are parallel to each other.

9. The electronic device as claimed in claim 8, wherein the extending portions extend in a first direction, and the positioning openings extend in the first direction.

10. The electronic device as claimed in claim 7, wherein the ground structures abut the first surface, and are welded to the second surface.

* * * * *